US007219848B2

(12) United States Patent
Sweeton

(10) Patent No.: US 7,219,848 B2
(45) Date of Patent: May 22, 2007

(54) FLUID SPRAYER EMPLOYING PIEZOELECTRIC PUMP

(75) Inventor: Steven L. Sweeton, Lake Winnebago, MO (US)

(73) Assignee: MeadWestvaco Corporation, Glen Allen, VA (US)

( * ) Notice: Subject to any disclaimer, the term of this patent is extended or adjusted under 35 U.S.C. 154(b) by 42 days.

(21) Appl. No.: 11/153,831

(22) Filed: Jun. 15, 2005

(65) Prior Publication Data

US 2006/0091160 A1 May 4, 2006

(51) Int. Cl.
*B05B 1/08* (2006.01)
*B05B 9/043* (2006.01)
*B05B 1/34* (2006.01)
*F04B 17/00* (2006.01)

(52) U.S. Cl. ..... 239/102.2; 239/311; 239/329; 239/333; 239/375; 239/463; 239/491; 222/83.1; 222/333; 417/413.2

(58) Field of Classification Search ..... 239/102.2, 239/311, 329, 333, 375, 463, 491, 102.1, 239/302, 330–332, 398, 399, 472, 486–490, 239/492, 493, 525–527; 222/383.1, 504, 222/333, 135, 136, 145.5, 249, 250; 417/413.2
See application file for complete search history.

(56) References Cited

U.S. PATENT DOCUMENTS 3,565,344 A * 2/1971 Takei et al. ..... 239/332
4,153,201 A 5/1979 Berger et al.
4,301,968 A 11/1981 Berger et al.
4,352,459 A 10/1982 Berger et al.
4,930,700 A 6/1990 McKown
5,150,841 A * 9/1992 Silvenis et al. ..... 239/332
5,234,166 A * 8/1993 Foster et al. ..... 239/333
5,397,034 A * 3/1995 Wunsch ..... 222/333
5,529,055 A 6/1996 Guret (Continued)

FOREIGN PATENT DOCUMENTS

WO WO 2004/084274 A2 9/2004

OTHER PUBLICATIONS

PAR Technologies, Data Sheet for Piezoelectric Pump, Model LPD-150S, pp. 1-4.*

(Continued)

*Primary Examiner*—Kevin Shaver
*Assistant Examiner*—Darren Gorman
(74) *Attorney, Agent, or Firm*—Gordon & Jacobson, PC

(57) ABSTRACT

An electrically-powered fluid sprayer employs a piezoelectric fluid pump that includes an inlet port, an outlet port, a pump chamber, and a piezoelectric element that is deformed and displaced by electrical signals supplied thereto to vary the volume of the pump chamber. Such displacement pumps fluid into the inlet port and into the pump chamber and discharges fluid from the pump chamber out the outlet port. The inlet port is in fluid-communication with a fluid reservoir. Spin mechanics may be disposed downstream from the outlet port of the fluid pump and upstream from the discharge nozzle. The piezoelectric fluid sprayer may be extended to include a dual chamber piezoelectric pump that pumps different fluids (e.g., a liquid and air). The output of the dual chamber pump is mixed in a manifold and supplied downstream to the discharge nozzle. Spin mechanics may be employed in the fluid stream upstream from the discharge nozzle after the mixing.

32 Claims, 4 Drawing Sheets

U.S. PATENT DOCUMENTS

| | | | | |
|---|---|---|---|---|
| 5,716,007 | A * | 2/1998 | Nottingham et al. | 239/332 |
| 6,554,211 | B1 * | 4/2003 | Prueter et al. | 239/332 |
| 2002/0011531 | A1 * | 1/2002 | DiMaggio et al. | 239/337 |
| 2003/0002995 | A1 * | 1/2003 | Urano et al. | 417/322 |
| 2004/0000843 | A1 | 1/2004 | East | |
| 2004/0021398 | A1 | 2/2004 | East | |
| 2004/0123490 | A1 * | 7/2004 | Pancheri et al. | 34/597 |
| 2005/0133626 | A1 * | 6/2005 | Hornsby et al. | 239/380 |

OTHER PUBLICATIONS

"Don't Spray Away Your Dollars" Rudolf J. Schick, downloaded from website Flow Control Network.com Nov. 1, 2004, http://www.flowcontrolnetwork.com/PastIssues/novdec2001/3.asp.

* cited by examiner

FLUID SPRAYER EMPLOYING PIEZOELECTRIC PUMP

BACKGROUND OF THE INVENTION

1. Field of the Invention

This invention relates broadly to electrically-powered fluid pumps. More particularly, this invention relates to an electrically-powered fluid pump contained in a spray head which is retrofittable onto existing pump spray containers.

2. State of the Art

Many household and industrial products are sold in containers that include a sprayer. These products include cleansers, insecticides, polishes, waxes, etc. There are several kinds of sprayers used with these products. Perhaps the most common is the push button or trigger operated pump which is seen most frequently on liquid cleansers. It has the advantage of being environmentally friendly but the disadvantage of delivering fluid in a series of pulses rather than in a continuous spray.

Another well known sprayer is the aerosol can which is sealed and charged with a gas propellant. This sprayer has the advantage that it dispenses fluid in a continuous spray, but has several disadvantages. One disadvantage is that the can cannot be refilled. Another disadvantage is that, depending on the gas used to charge the container, it can be environmentally unfriendly. Moreover, environmentally friendly propellants do not charge as well as the unfriendly gases.

Still another popular sprayer is the air pump sprayer seen most frequently with insecticides and liquid garden products. The pump sprayer includes a hand operated air pump which is used to charge the container with compressed air. After it is charged, it operates much like an aerosol can. The pump sprayer is environmentally friendly but requires a lot of effort to keep it charged because air is not as efficient a propellant as environmentally unfriendly gases such as FREON or hydrocarbon gasses.

In recent years there has been some experimentation with electrically powered pump sprayers. Most of these devices include a spray mechanism which is similar to the ubiquitous push button (or trigger) pump sprayer but which is coupled to a battery powered electric motor by a linkage which converts the rotary action of the motor to an oscillatory motion to drive the pump piston. Many of these battery operated pump sprayers are designed to work only with a specially constructed bottle, i.e. they are not retrofittable to existing pump spray bottles. They also are heavy, expensive, and have poor power consumption (and reduced battery life) due to the weight and cost of the electric motor. Many of these battery powered pumps also have large priming volumes, thus causing a delay between the time the pump is activated and the time liquid begins to be dispensed. Significantly, these pumps do not really provide a constant spray. They provide a continuous pulsed spray like that obtained by repeatedly squeezing the trigger of pushing the button on a hand operated spray pump.

SUMMARY OF THE INVENTION

It is therefore an object of the invention to provide an electrically-powered pump spray head that can be readily adapted to interface to existing pump spray bottles.

It is another object of the invention to provide an electrically-powered pump sprayer that has improved power consumption, lower costs, and reduced weight.

It is a further object of the invention to provide an electrically-powered sprayer that has a small-sized priming volume which is preferably self-priming during operation of the pump.

It is also an object of the invention to provide an electrically-powered sprayer that provides a substantially constant spray from a discharge nozzle.

In accord with these objects, which will be discussed in detail below, an electrically-powered fluid sprayer employs a piezoelectric fluid pump that includes an inlet port, an outlet port, a pump chamber, and a piezoelectric element that is deformed and displaced by electrical signals supplied thereto to vary the volume of the pump chamber. Such displacement pumps fluid into the inlet port and into the pump chamber and discharges fluid from the pump chamber out the outlet port. The inlet port is in fluid communication with a fluid reservoir. Spin mechanics are disposed downstream from the outlet port of the fluid pump and upstream from the discharge nozzle.

It will be appreciated that the electrically-powered sprayer of the present invention can be readily adapted to interface to existing pump spray bottles. It also has improved power consumption, lower costs, and reduced weight. It also can be readily adapted to have a small priming volume which is preferably self-priming during operation of the pump. It can also be readily adapted to provide a substantially constant spray from the discharge nozzle.

According to one embodiment of the invention, the piezoelectric element of the pump comprises a piezoelectric diaphragm.

According to another embodiment of the invention, the piezoelectric element is driven by battery powered circuitry.

According to another embodiment of the invention, the elements of the electrically-powered fluid sprayer are supported in a hand-holdable housing with a trigger, and the pizeoelectric element is activated by the user pressing the trigger.

In another aspect of the present invention, an electrically-powered fluid sprayer employs a dual chamber piezoelectric fluid pump that includes a first inlet port, a first outlet port, a first pump chamber, a second inlet port, a second outlet port, a second pump chamber, and at least one piezoelectric element that is deformed and displaced by electrical signals supplied thereto to vary the volume of the first and second pump chambers. Such displacement pumps a first fluid into the first inlet port and into the first pump chamber and discharges fluid from the first pump chamber out the first outlet port. Such displacement also pumps a second fluid into the second inlet port and to the second pump chamber and discharge fluid from the second pump chamber out the second outlet port. The inlet ports are in fluid communication with separate fluid reservoirs (or possibly one in fluid communication with a fluid reservoir and the other in fluid communication with ambient air). A mixing manifold is disposed downstream from the first and second outlet ports of the fluid pump and upstream from the discharge nozzle. The mixing manifold is adapted to mix the first and second fluids discharged from the first and second outlet ports of the pump. Spin mechanics may be disposed upstream from the discharge nozzle.

According to one embodiment of the invention, the first and second pump chambers are disposed on opposite sides of a single piezoelectric element.

According to another embodiment of the invention, the first and second pump chambers each include a separate and distinct piezoelectric element.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
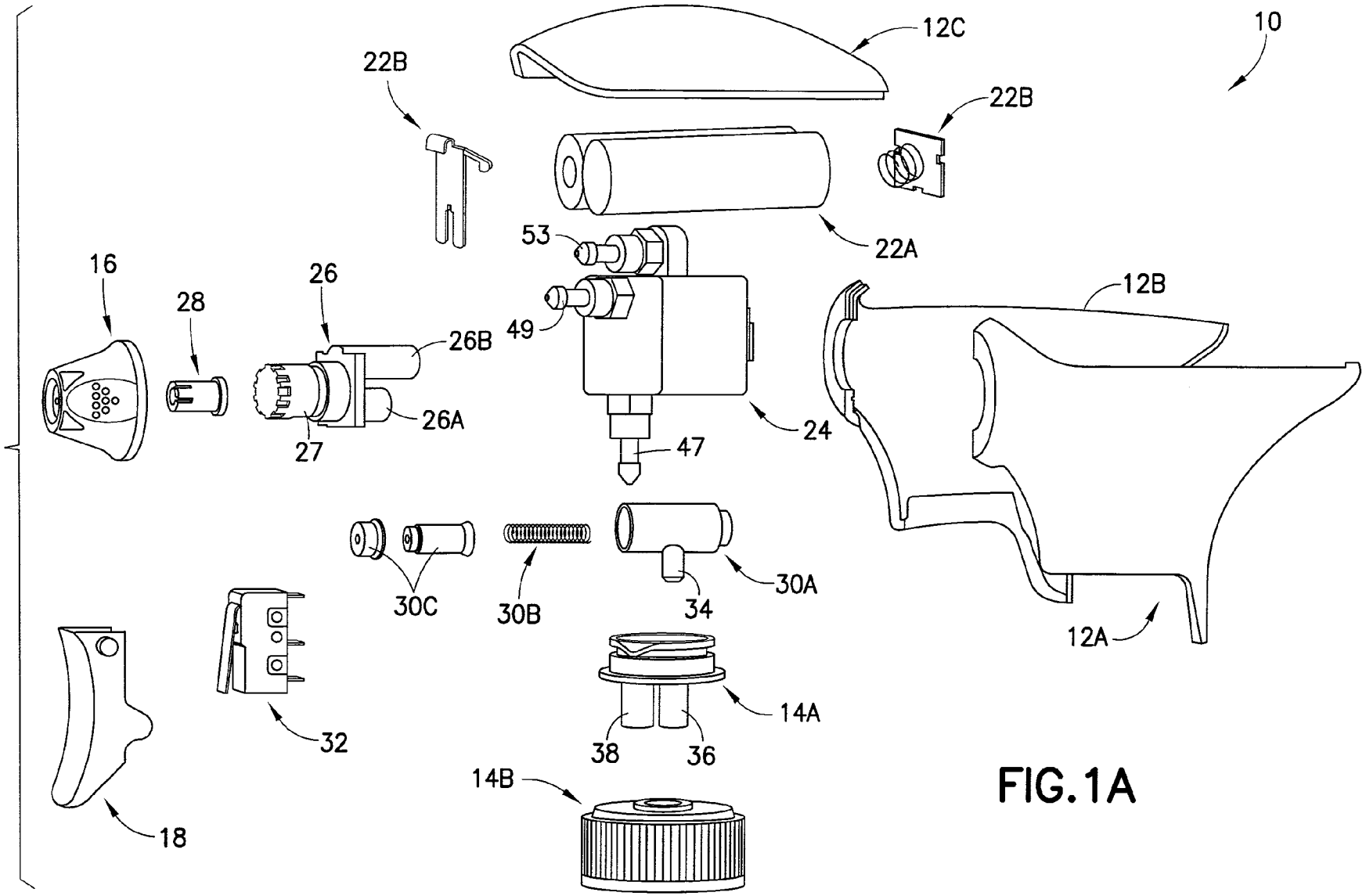
FIG. 1A is an exploded view of the spray head of the invention.
Figure 1B:
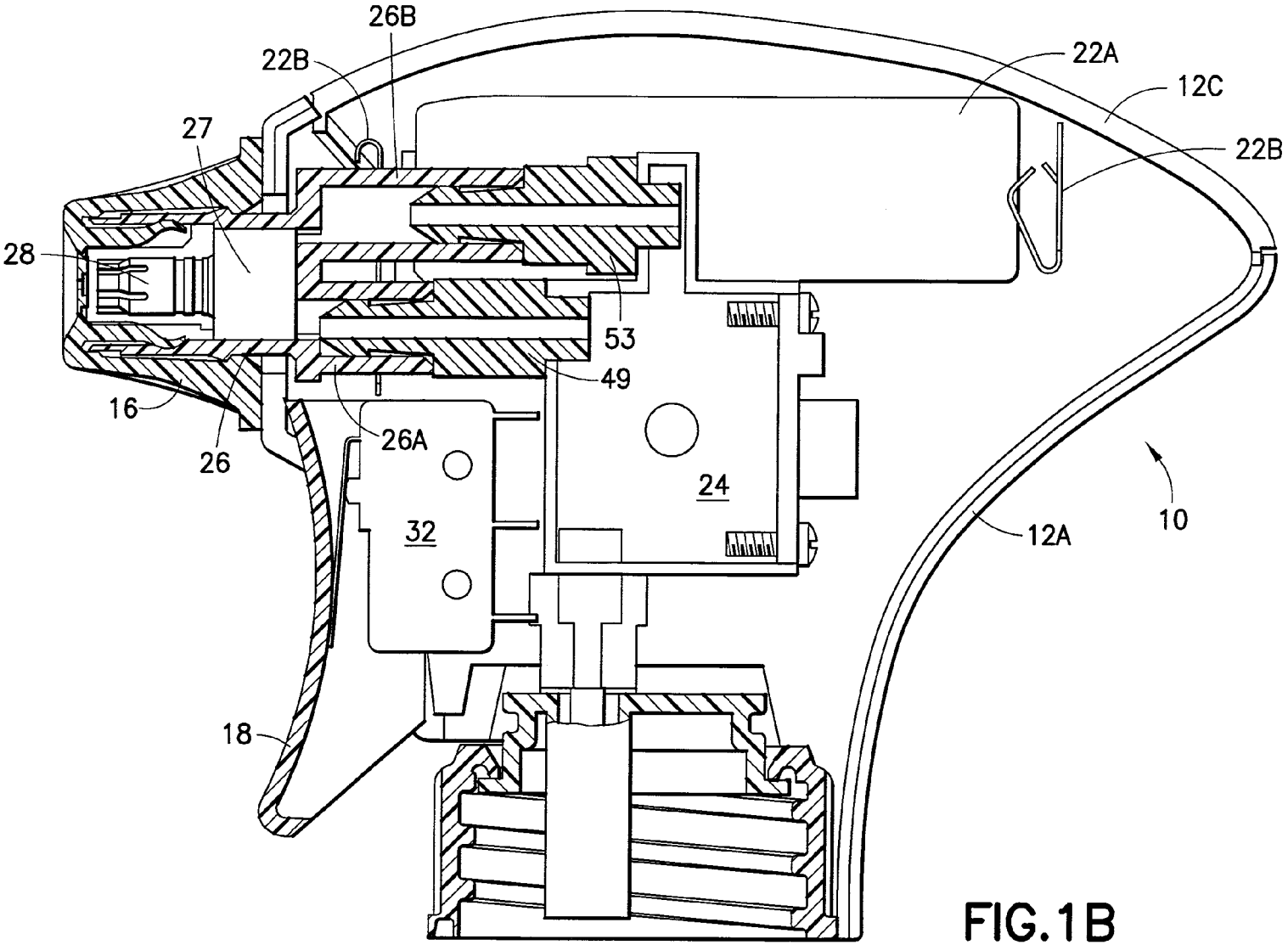
FIG. 1B is a cross-sectional view of the spray head of the invention.

Turning now to FIGS. 1A and 1B, a battery operated spray head 10 according to the invention includes an ergonomic housing 12 with three parts—left side part 12A, right side part 12B, and top cover 12C. The left and right side parts 12A, 12B support a two part threaded bottle coupling 14 having a retainer 14A and a closure 14B. The housing 12 displays a discharge nozzle 16 and a trigger 18. The left and right side parts 12A, 12B of the housing 12 extend about the coupling 14 in a shape adapted to be comfortably gripped by the hand of the user when the user squeezes the trigger 18. An electrical power source 22 (batteries 22A and contacts 22B), a dual chamber piezoelectric liquid and air pump 24, a mixing manifold 26 and optional swirl mechanics 28 are mounted inside the housing 12 when assembled. The trigger 18 is arranged so that when it is squeezed, it operates a vent valve 30 and an electrical switch 32. The valve 30, which preferably is realized by a cylindrical body 30A that houses a spring 30B and two part piston valve member 30C as shown, selectively opens an air path from the atmosphere to the interior of the bottle via a vent opening (not shown) into the valve 30 and a vent passage 34 which extends from the valve body 30A to the coupling 14. The electrical switch 32 selectively couples the electrical power source 22 to the piezoelectric liquid and air pump 24 to drive the pump 24 as described below. The operation of the vent valve 30 and the switch 32 can be linked to the trigger 18 for simultaneous actuation or series actuation when energizing the pump 24. The top cover 12C preferably can be removed by the user to gain access to the batteries 22A in order to replace the batteries 22A as needed.

The retainer 14A includes a vent port (not shown) that terminates a vent passageway 36 through the retainer 14A into the interior of a bottle (not shown) during use. The vent passage 34 of the vent valve 30 mates to the vent port of the retainer 14A to provide fluid communication between the vent valve 30 and the interior of the bottle during use. The retainer 14A also includes a liquid supply port (not shown) that terminates a liquid supply passageway 38 through the retainer. A dip tube (not shown) extends from the liquid supply passageway 38 into the interior of the bottle as is well known. The liquid inlet port 47 of the pump 24 mates to the liquid supply port of the retainer 14A to provide fluid communication between liquid inlet port 47 and the interior of the bottle to supply liquid thereto during use. The bottle may hold any one of a number of household and industrial liquid products (such as cleansers, insecticides and other liquid garden products, polishes, waxes), personal care products, or other liquid products.

Figure 2:
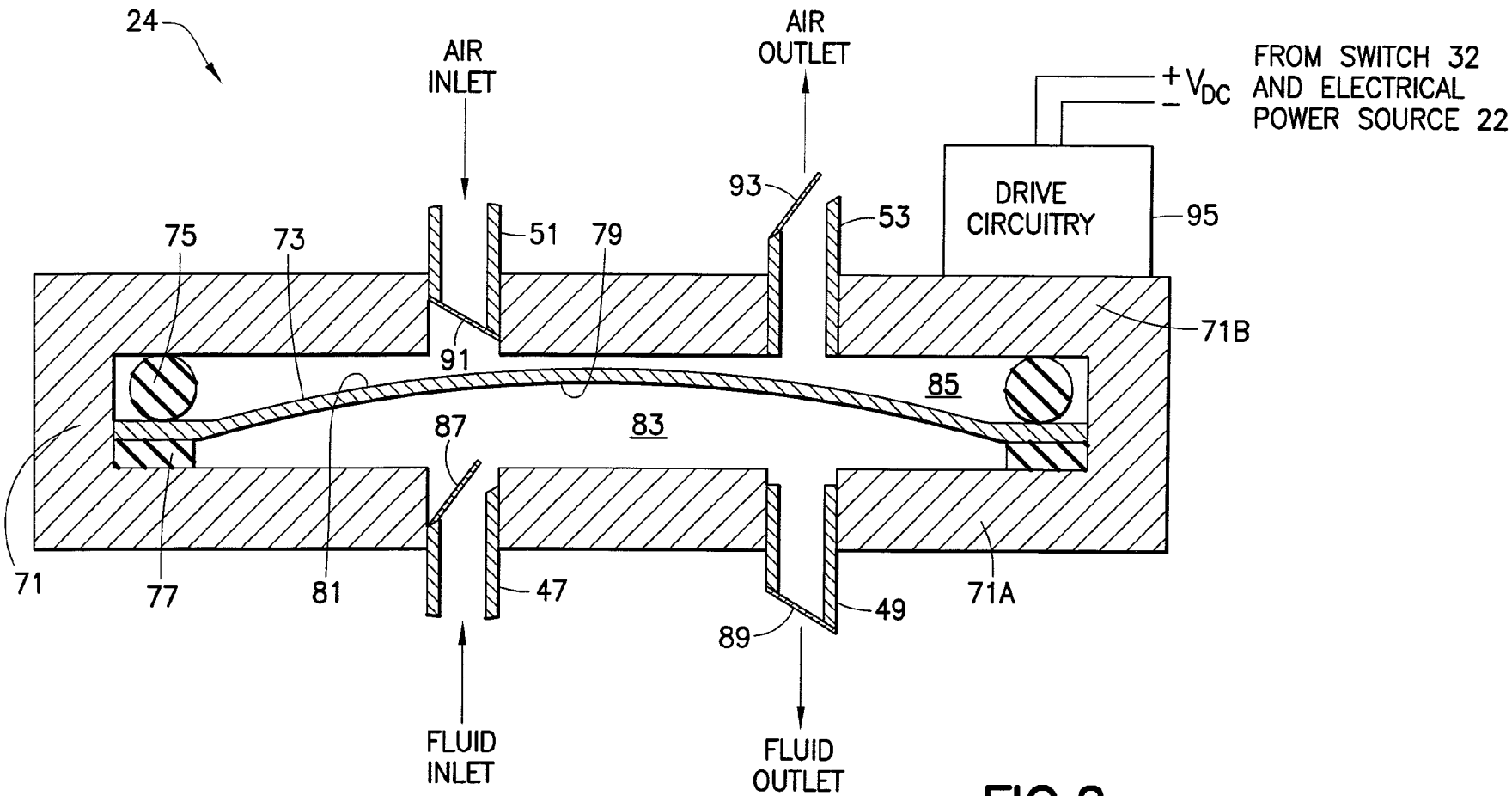
FIG. 2 is a cross-sectional view of a first embodiment of a piezoelectric fluid and air pump of the invention.

The dual chamber piezoelectric liquid and air pump 24 includes the liquid inlet port 47, a liquid outlet port 49, an air inlet port 51 (which may be realized by a passageway through the underside of the pump, which is not shown in FIG. 1A, but is seen in FIG. 2) and an air outlet port 53. The liquid outlet port 49 is in fluid communication with one leg 26A of the mixing manifold 26, while the air outlet port 53 is in fluid communication with the other leg 26B of the mixing manifold 26. The air inlet port 51 of the pump 24 provides an air path to atmosphere.

As described below in detail, the pump 24 includes a liquid pump chamber in fluid communication with the liquid inlet port 47 and the liquid outlet port 49, as well as an air pump chamber in fluid communication with the air inlet port 51 and the air outlet port 53. One or more piezoelectric diaphragms are deformed and displaced in response to electric signals applied thereto to change the volume of the liquid pump chamber and the air pump chamber, respectively. The electric signals that drive the piezoelectric diaphragm(s) are generated by drive circuitry, which is preferably integrated as part of the pump 24, that is coupled in either a wired or wireless manner to the electrical power source 22 via the switch 32. Such displacement causes liquid to be drawn into the liquid inlet port 47 and into the liquid pump chamber and then discharged out the liquid outlet port 49. It also causes air to be drawn into the air inlet port 51 and into the air pump chamber and then discharged out the air outlet port 53.

As previously described, the liquid outlet port 49 and the air outlet port 53 are in fluid communication with respective legs 26A, 26B of the mixing manifold 26, which includes a mixing chamber 27 that is configured to channel the flow of liquid and air discharged from the liquid outlet port 49 and air outlet port 53 to create a fluid or gaseous mixture. For example, the liquid and air can be mixed such that the air is entrained into the fluid for purposes of reducing fluid particle size and/or creating a fluid foam.

The mixing manifold 26 also supports optional spin mechanic 28 and the discharge nozzle 16, which are operably disposed downstream from the mixing chamber 27. The spin mechanics 28 impart a swirl to fluid passing therethrough for discharge from the nozzle 16. The discharge nozzle 16 is preferably adapted to allow the user to select different spray patterns and to permit the flow channels to be turned on and off by rotating the nozzle 16 as is well known in the liquid sprayer arts.

As shown in the exemplary embodiment of FIG. 2, the dual chamber piezoelectric liquid and air pump 24 includes a pump body 71 that houses a piezoelectric diaphragm 73 supported by a first sealing member 75 (e.g., O-ring) and a second sealing member 77 (e.g., sealing washer). The pump body 71, the piezoelectric diaphragm 73, and the supporting elements may be square, rectangular, or annular in nature and preferably have a maximum dimension on the order of 25–100 mm. The piezoelectric diaphragm 73 has a liquid-contacting surface 79 disposed opposite an air-contacting surface 81 as shown. The lower part 71A of the body and the liquid-contacting surface 79 define a liquid pump chamber 83, while the upper part 71B of the body and the air-contacting surface 81 define an air pump chamber 85. A liquid inlet check valve 87 is operably disposed between the liquid inlet port 47 and the liquid pump chamber 83. A liquid outlet check valve 89 is operably disposed between the liquid pump chamber 83 and the liquid outlet port 49. Similarly, an air inlet check valve 91 is operably disposed between the air inlet port 91 and the air pump chamber 85.

An air outlet check valve 93 is operably disposed between the air pump chamber 85 and the air outlet port 93.

Drive circuitry 95 is operably coupled to the electrical power source 22 via the electrical switch 32. The drive circuitry 95 applies a time varying electric signal to the piezoelectric diaphragm such that it is deformed and displaced in an oscillating manner to thereby vary the size of the liquid pump chamber 83 and the air pump chamber 85, respectively. During the liquid intake stroke (displacement of the diaphragm 77 away from liquid inlet port 47 and the liquid outlet port 49), the diaphragm 77 draws liquid into the liquid inlet port 47 and into the liquid pump chamber 83. During the liquid discharge stroke (displacement of the diaphragm 77 toward the liquid inlet port 47 and the liquid outlet port 49), the diaphragm 77 discharges the liquid from the fluid pump chamber 83 out the liquid outlet port 49. During the air intake stroke (which corresponds to the liquid discharge stroke), the diaphragm 77 draws air into the air inlet port 51 and into the air pump chamber 85. During the air discharge stroke (which corresponds to the liquid intake stroke), the diaphragm 77 discharges the air from the air pump chamber 85 out the air outlet port 53.

The piezoelectric diaphragm 77 is preferably formed with a natural shape that is flat or dome-shaped and from a polycrystalline ferroelectric material as set forth in International Patent Application WO 2004/084274, herein incorporated by reference in its entirety. In this illustrative embodiment, the piezoelectric diaphragm 77 can be driven with a sinusoidal or square wave alternating current as set forth therein. The pump frequency (which corresponds to the frequency of oscillation of the AC drive signal applied to the diaphragm) can be varied based upon the particular application, but is preferably significantly less than 20 kHz and most preferably between 35 Hz and about 85 Hz. Such frequencies generate a substantially continuous spray which is discharged through the discharge nozzle.

Figure 3:
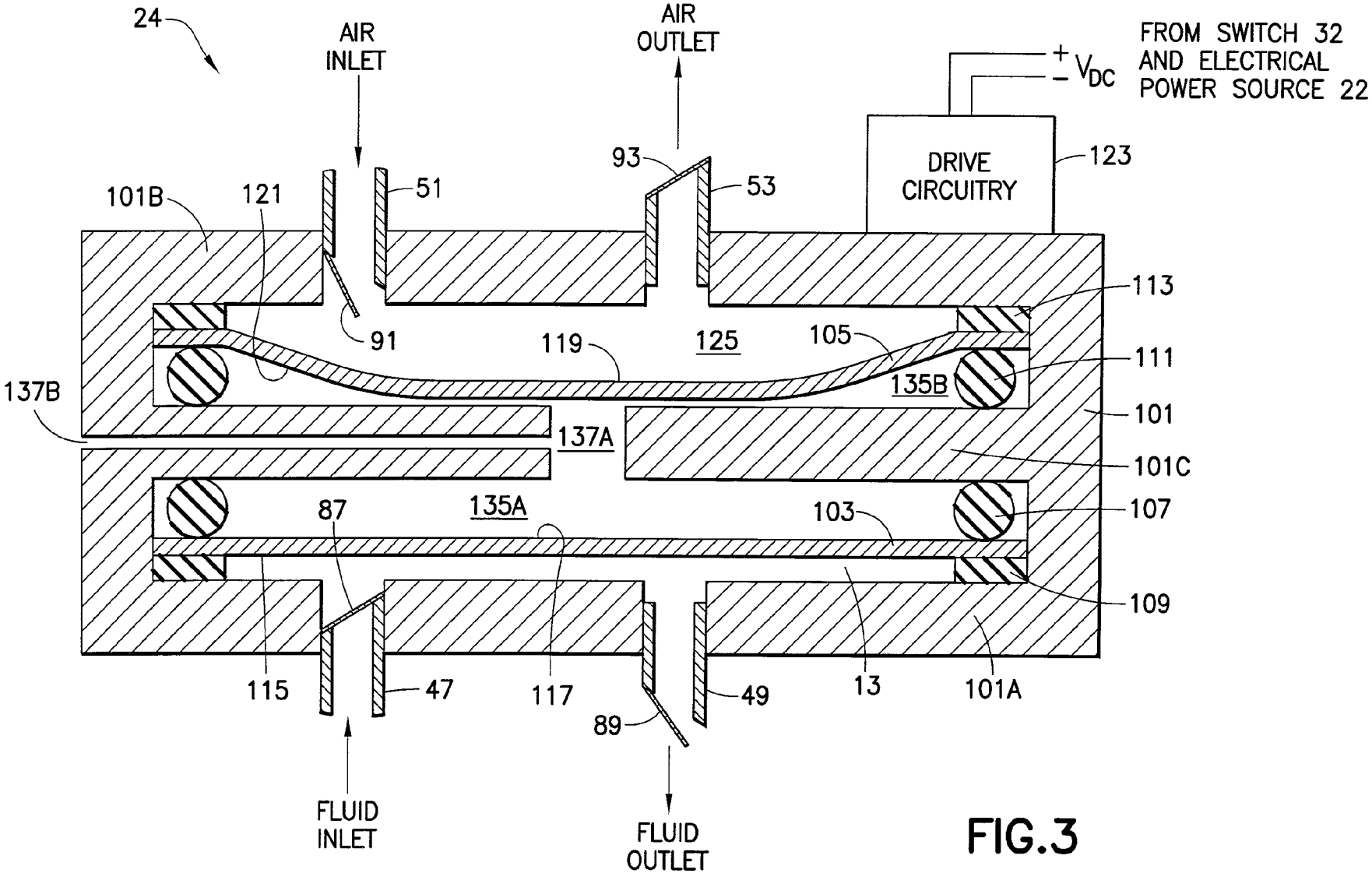
FIG. 3 is a cross-sectional view of a second embodiment of a piezoelectric fluid and air pump of the invention.

In an alternate embodiment as shown in FIG. 3, the dual chamber piezoelectric liquid and air pump 24 includes a pump body 101 that houses first and second piezoelectric diaphragms 103, 105. The first piezoelectric diaphragm 103 is supported by sealing member 107 (e.g., O-ring) and a sealing member 109 (e.g., sealing washer). The second piezoelectric diaphragm 105 is supported by sealing member 111 (e.g., O-ring) and a sealing member 113 (e.g., sealing washer). The first piezoelectric diaphragm 103 has a liquid-contacting surface 115 disposed opposite a rear-venting surface 117 as shown. The second piezoelectric diaphragm 105 has an air-contacting surface 119 disposed opposite a rear-venting surface 121 as shown. The lower part 101A of the body and the liquid-contacting surface 115 of the first piezoelectric diaphragm 103 define a liquid pump chamber 123, while the upper part 101B of the body and the air-contacting surface 119 of the second piezoelectric diaphragm 105 define an air pump chamber 125. The rear-venting surfaces 117 and 121 and an interior body wall 101C define vent chambers 135A, 135B that are vented to atmosphere by passageways 137A and 137B as shown. A liquid inlet check valve 87 is operably disposed between the liquid inlet port 47 and the liquid pump chamber 83. A fluid outlet check valve 89 is operably disposed between the liquid pump chamber 123 and the liquid outlet port 49. Similarly, an air inlet check valve 91 is operably disposed between the air inlet port 91 and the air pump chamber 125. An air outlet check valve 93 is operably disposed between the air pump chamber 125 and the air outlet port 93.

Drive circuitry 123 is operably coupled to the electrical power source 22 via the electrical switch 32. The drive circuitry 123 applies a time varying electric signal to the piezoelectric diaphragms 103, 105 such that they are deformed and displaced in an oscillating manner to thereby vary the size of the liquid pump chamber 123 and the air pump chamber 125, respectively. During the liquid intake stroke (displacement of the first piezoelectric diaphragm 103 away from the liquid inlet port 47 and the liquid outlet port 49), the first piezoelectric diaphragm 103 draws liquid into the liquid inlet port 47 and into the liquid pump chamber 123. During the liquid discharge stroke (displacement of the first piezoelectric diaphragm 103 toward the liquid inlet port 47 and the liquid outlet port 49), the first piezoelectric diaphragm 103 discharges the liquid from the liquid pump chamber 123 out the liquid outlet port 49. During the air intake stroke (which preferably is synchronous to the liquid discharge stroke), the second piezoelectric diaphragm 105 draws air into the air inlet port 51 and into the air pump chamber 125. During the air discharge stroke (which preferably is synchronous to the liquid intake stroke), the second piezoelectric diaphragm 105 discharges the air from the air pump chamber 125 out the air outlet port 53.

The piezoelectric diaphragms 103, 105 are preferably formed with a natural shape that is flat or dome-shaped and from a polycrystalline ferroelectric material as set forth in International Patent Application WO 2004/084274. In this illustrative embodiment, the piezoelectric diaphragms 103, 105 can be driven with a sinusoidal or square wave alternating current as set forth therein. The pump frequency (which corresponds to the frequency of oscillation of the AC drive signal applied to the diaphragms) can be varied based upon the particular application, but is preferably significantly less than 20 kHz and most preferably between 35 Hz and about 85 Hz.

The liquid inlet and outlet check valves 87, 89 as well as the air inlet and outlet check valves 91, 93 are preferably flexible disk shaped members that selectively block fluid communication through a passageway as are well known in the liquid sprayer arts. In the preferred embodiment, such check valves may be realized by an elliptical disk that is the same size and shape as the end of a tubular passageway formed at a 45° angle to the axis of the tubular passageway. The inlet and outlet check valves have absolute minimum bulk. Moreover, the mass of such check valves are minimized so that they react rapidly to the action of the piezoelectric diaphragm(s). Such valves preferably allow the respective pump chambers 83, 85 to be self-priming since employment of the two valves for each respective chamber may create a sufficient vacuum to draw fluid into the respective chamber. Other small-size check valves, such as flapper valves or spring-biased ball valves may be used as well. In alternate embodiments, the outlet check valves of the system may be omitted.

There have been described and illustrated herein several embodiments of a fluid sprayer employing a dual chamber piezoelectric pump chamber. While particular embodiments of the invention have been described, it is not intended that the invention be limited thereto, as it is intended that the invention be as broad in scope as the art will allow and that the specification be read likewise. Thus, while discrete piezoelectric pumping chambers have been disclosed for pumping a liquid and air for downstream mixing in the mixing manifold, the discrete chambers can be used for pumping any combination of fluids (including gases) for downstream mixing and dispensing. Furthermore, while manually-actuatable venting mechanisms have been disclosed, it will be appreciated that other venting mechanisms can be used as well. For example, a 'static' valve may be provided in communication with the drawn upon liquid reservoir for the purpose of venting the liquid reservoir. The 'static' vent is activated by negative pressure generated in the liquid reservoir as the result of pumping liquid from the reservoir. In addition, while particular types, shapes and configurations of piezoelectric actuators have been disclosed, it will be understood the other types, shapes and configurations can be used. Furthermore, additional electrically-powered components may be integrated into the system. For example, a battery-powered piezoelectric atomizing element can be placed in the fluid path downstream from the pump. The atomizing element is driven such that it vibrates, typically at ultrasonic frequencies, in a manner that atomizes the fluid directed thereto. Moreover, while particular configurations have been disclosed in reference to a bottle-mounted hand-held liquid sprayer device, it will be appreciated that other configurations could be used as well. For example, the dual chamber pump system described herein can be used in a wide variety of bottle-mounted hand-held liquid sprayer heads (with or without neck-downed handles), remote sprayer configurations and stationary devices (such as fragrance atomizers which may be mounted on the floor, tabletop, or wall). In yet other embodiments, a piezoelectric actuated single pump chamber design can be used to pump fluid, such as a liquid, as part of a fluid sprayer head. Still in yet other embodiments, alternate electrical power sources, such as mains-based transformers and the like, may be used to drive the piezoelectric elements of the fluid spray system described herein. It will therefore be appreciated by those skilled in the art that yet other modifications could be made to the provided invention without deviating from its spirit and scope as claimed.

What is claimed is:

1. An electrically-operated fluid sprayer comprising:

a fluid pump including an inlet port, an outlet port, a pump chamber, and a piezoelectric element;

drive circuitry coupled to said piezoelectric element such that said piezoelectric element is deformed to vary the volume of said pump chamber in order to pump fluid into said inlet port and into said pump chamber and discharge fluid from said pump chamber out said outlet port;

an electrical power source coupled to said drive circuitry, said electrical power source comprising at least one battery;

an electrical switch for selectively activating said drive circuitry to thereby selectively control deformation and displacement of said piezoelectric element;

spin mechanics disposed downstream from said outlet port of said fluid pump; and a discharge nozzle coupled to said spin mechanics;

wherein said pump, discharge nozzle, spin mechanics, at least one battery, electrical switch, and drive circuitry are supported in a hand-holdable housing supporting a coupling that removably engages a reservoir of liquid fluid to be dispensed by the fluid sprayer.

2. An electrically-operated fluid sprayer according to claim 1, wherein:

said piezoelectric element comprises a piezoelectric diaphragm.

3. An electrically-operated fluid sprayer according to claim 1, further comprising:

a trigger for manually actuating said electrical switch.

4. An electrically-operated fluid sprayer according to claim 1, wherein:

said coupling includes a liquid supply passageway and a vent passageway therethrough.

5. An electrically-operated fluid sprayer according to claim 3, further comprising:

venting means for selectively venting the reservoir in fluid communication with said inlet port of said pump, wherein said venting means is manually actuated by operation of said trigger.

6. An electrically-operated fluid sprayer according to claim 1, further comprising:

venting means for selectively venting the reservoir in fluid communication with said inlet port of said pump.

7. An electrically-operated fluid sprayer comprising:

a fluid pump including a first inlet port, first outlet port, a first pump chamber, a second inlet port, a second outlet port, a second pump chamber, and at least one piezoelectric element;

drive circuitry coupled to said at least one piezoelectric element such that said at least one piezoelectric element is deformed to vary the volume of said first and second pump chambers in order to pump a first fluid into said first inlet port and to said first pump chamber and discharge fluid from said first pump chamber out said first outlet port, and to pump a second fluid into said second inlet port and to said second pump chamber and discharge fluid from said second pump chamber out said second outlet port;

a mixing manifold disposed downstream from said first and second outlet ports of said fluid pump, said mixing manifold adapted to mix the first and second fluids discharged from said first and second outlet ports of said pump; and a discharge nozzle coupled downstream of said mixing manifold.

8. An electrically-operated fluid sprayer according to claim 7, further comprising:

spin mechanics disposed upstream from said discharge nozzle.

9. An electrically-operated fluid sprayer according to claim 7, wherein:

said first pump chamber and said second pump chamber are disposed on opposite sides of a single piezoelectric element.

10. An electrically-operated fluid sprayer according to claim 7, wherein:

said first pump chamber and said second pump chamber each include a separate and distinct piezoelectric element.

11. An electrically-operated fluid sprayer according to claim 7, wherein:

said at least one piezoelectric element comprises a piezoelectric diaphragm.

12. An electrically-operated fluid sprayer according to claim 7, further comprising:

an electrical power source; and an electrical switch for selectively activating said drive circuitry to thereby selectively control deformation and displacement of said at least one piezoelectric element.

13. An electrically-operated fluid sprayer according to claim 12, further comprising:

a trigger for manually actuating said electrical switch.

14. An electrically-operated fluid sprayer according to claim 12, wherein:

said electrical power source comprises at least one battery.

15. An electrically-operated fluid sprayer according to claim 14, wherein:

said pump, discharge nozzle, mixing manifold, at least one battery, electrical switch, and drive circuitry are supported in a hand-holdable housing.

16. An electrically-operated fluid sprayer according to claim 15, wherein:

said hand-holdable housing supports a coupling that removably interfaces to a reservoir of liquid fluid to be dispensed by the fluid sprayer.

17. An electrically-operated fluid sprayer according to claim 16, wherein:

said first fluid comprises a liquid and said second fluid comprises a gas.

18. An electrically-operated fluid sprayer according to claim 17, wherein:

said gas comprises air.

19. An electrically-operated fluid sprayer according to claim 18, wherein:

said coupling including a liquid supply passageway and a vent passageway therethrough.

20. An electrically-operated fluid sprayer according to claim 19, further comprising:

venting means for selectively venting said liquid reservoir, wherein said venting means is manually actuated by operation of a trigger that actuates said electrical switch.

21. An electrically-operated fluid sprayer according to claim 1, further comprising:

an inlet check valve element disposed adjacent said pump chamber.

22. An electrically-operated fluid sprayer according to claim 21, wherein:

said inlet check valve element comprises a flexible elastomeric member.

23. An electrically-operated fluid sprayer according to claim 21, further comprising:

an outlet check valve element disposed adjacent said pump chamber.

24. An electrically-operated fluid sprayer according to claim 23, wherein:

said outlet check valve element comprises a flexible elastomeric member.

25. An electrically-operated fluid sprayer according to claim 7, further comprising:

a first inlet check valve element disposed adjacent said first pump chamber, and a second inlet check valve element disposed adjacent said second pump chamber.

26. An electrically-operated fluid sprayer according to claim 25, wherein:

said first and second inlet check valve elements each comprise a flexible elastomeric member.

27. An electrically-operated fluid sprayer according to claim 25, further comprising:

a first outlet check valve element disposed adjacent said first pump chamber, and a second outlet check valve element disposed adjacent said second pump chamber.

28. An electrically-operated fluid sprayer according to claim 27, wherein:

said first and second outlet check valve elements each comprise a flexible elastomeric member.

29. An electrically-operated fluid sprayer according to claim 1, wherein:

said drive circuitry applies an AC drive signal having a frequency less than 20 kHz.

30. An electrically-operated fluid sprayer according to claim 29, wherein:

said frequency is between 35 Hz and 85 Hz.

31. An electrically-operated fluid sprayer according to claim 7, wherein:

said drive circuitry applies an AC drive signal having a frequency less than 20 kHz.

32. An electrically-operated fluid sprayer according to claim 31, wherein:

said frequency is between 35 Hz and 85 Hz.

* * * * *